United States Patent [19]

Stern et al.

[11] 4,423,569

[45] Jan. 3, 1984

[54] AUTOMATIC LENS EDGER

[75] Inventors: Theodore J. Stern, Woodland Hills, Calif.; Wilfredo P. Loreto, Hoffman Estates, Ill.

[73] Assignee: AIT Industries, Inc., Schaumburg, Ill.

[21] Appl. No.: 307,852

[22] Filed: Oct. 2, 1981

[51] Int. Cl.[3] ..... B24B 9/14

[52] U.S. Cl. ..... 51/101 LG; 51/165.71

[58] Field of Search ..... 51/101 LG, 165.71, 165 TP

[56] References Cited

U.S. PATENT DOCUMENTS

| | | | |
|---|---|---|---|
| 2,651,890 | 9/1953 | Rubinstein | 51/101 LG |
| 3,332,172 | 7/1967 | Stern | 51/101 LG |
| 3,461,619 | 8/1969 | Hurlbut | 51/101 LG |
| 3,745,720 | 7/1973 | Savage | 51/101 LG |
| 4,274,231 | 6/1981 | Verega | 51/165.71 |

*Primary Examiner*—Harold D. Whitehead

*Attorney, Agent, or Firm*—Gary, Juettner & Pyle

[57] ABSTRACT

An apparatus for edging the periphery of an ophthalmic lens to a predetermined outline or edge configuration, is characterized by a pair of grinding wheels, one for rough grinding or shaping the lens and the other for peripherally beveling the edge of the lens, a workholder for supporting and rotating the lens and mechanisms for moving the rotating lens into engagement with the grinding wheels. Manual controls are on the apparatus and automatic control circuitry is in a module remote from but electrically connected with the apparatus, whereby the apparatus may be manually and/or automatically controlled to only shape a lens, to only bevel edge a lens or to both shape and bevel edge a lens. In normal operation, the manual and automatic controls cooperate to control the apparatus in the edging of lenses, but circuitry is provided to enable lenses to be edged completely under manual control in the event of a failure of the automatic circuitry, so that failure of the automatic circuitry does not disable the apparatus.

8 Claims, 8 Drawing Figures

AUTOMATIC LENS EDGER

BACKGROUND OF THE INVENTION

The present invention relates to apparatus for grinding the peripheries of articles to a predetermined outline or edge configuration, and in particular to an apparatus for automatically grinding the edges of eyeglass lenses to a predetermined configuration.

The present invention is particularly adapted to be used in connection with apparatus for grinding the peripheries of eyeglass lenses. One such apparatus is shown in Canadian Pat. No. 776,380, issued Jan. 23, 1968, wherein a lens is carried in a rotary workholder driven by a motor such that the edge of the lens may engage grinding wheels driven by another motor. The workholder is mounted on a carriage for movement toward and away from the grinding wheels, as well as in directions parallel to the axis of the wheels. The edge of the rotating lens is first brought against a cylinderical outer peripheral surface of a roughing wheel to rough grind the outer periphery of the lens to a desired shape, and the lens is then shifted into engagement with a V-shaped groove of a beveling wheel to form a projecting double on the periphery of the lens. During the beveling operation the workholder is rendered free to travel from side to side, in order that the edge of the lens will be automatically centered in the groove in the wheel. The resulting bevel on the edge of the lens enables mounting of the lens in an eyeglass frame.

Another apparatus for edging the peripheries of eyeglass lenses is disclosed in U.S. Pat. No. 3,332,172 issued July 25, 1967. In that apparatus, a rotary workholder for carrying and rotating a lens is movable along an axis toward and away from a pair of grinding wheels. To accomplish roughing and bevel edging of the lens, the grinding wheels are recipricable along their axis, and are positioned so that the rotating lens is first brought against a cylinderical outer periphery of a roughing wheel to grind the periphery of the lens to a desired shape, and are then shifted so that the lens may be brought into engagement with a V-shaped groove of a beveling wheel to form a projecting double on the periphery of the lens. During the beveling operation, but not during roughing, the workholder and lens are rendered free to travel from side to side, in order that the edge of the lens will automatically be centered in the groove in the wheel.

Although lens edgers of the aforementioned types are usually referred to as automatic lens edgers, each stage or step of the "automatic" process is manually controlled or initiated. To this end, manually operable controls are provided on the apparatus, and must be actuated in a selected sequence in accordance with whether a lens is to be rough ground or shaped only, bevel edged only or both rough ground and bevel edged.

In improving upon lens edging machines of the manually controlled type, some state of the art lens edging machines now come equipped with automatic control circuitry which allows a particular manufacturing sequence for a lens, once manually selected and initiated, to be automatically completed. Such lens edgers include, in addition to the automatic controls, manually operable controls for selectively manually implementing and controlling, if desired, individual stages of the manufacturing process. However, a disadvantage of such lens edgers is that the manual controls rely for their operation on the automatic controls, with the result that failure of the automatic controls results in the lens edger being disabled and placed out of use until the automatic controls are repaired.

OBJECTS OF THE INVENTION

An object of the present invention is to provide an automatic lens edging machine which is either automatically or manually operable to perform single or multiple finishing operations on a lens.

Another object is to provide such a lens edging machine wherein control circuitry for automatic operation of the machine is in a module remote from the machine, manual controls for manual operation of the machine are on the machine itself, and wherein upon any failure of the automatic control circuitry the machine may be operated solely by means of the manual controls.

SUMMARY OF THE INVENTION

In accordance with the present invention, an apparatus for grinding the peripheral edges of ophthalmic lenses to a predetermined configuration comprises a pair of grinding wheels, one a rough grinding wheel and the other a bevel edging wheel, rotating about a first axis, and a rotary workholder for supporting and rotating a lens about a second axis generally parallel to the first. A first motor means is operable to shift said grinding wheels and workholder relative to each other to selectively position the periphery of the lens opposite from a grinding surface of one of said grinding wheels, and a second motor means is cyclically operable to rotate said workholder and to then sequentially (a) move said grinding wheels and workholder toward each other to engage the periphery of the rotating lens with the grinding surface of the wheel opposite from the lens, (b) move said grinding wheels and workholder toward and away from each other in a predetermined manner while the rotating lens is engaged with the grinding surface to grind the periphery of the lens to a predetermined configuration, and (c) move said grinding wheels and workholder away from each other to disengage the lens from the grinding surface. A first circuit means, including first and second switches each manually actuable between first and second states, controls operation of said first and second motor means, such that actuation of said first switch to its first state operates said first motor means to position the lens opposite from said rough grinding wheel and actuation of said first switch to its second state operates said first motor means to position the lens opposite from said bevel edging wheel, while actuation of said second switch to its second state initiates a cycle of operation of said second motor means. A second circuit means is electrically connected with but separate and disconnectable from said first circuit means, and said second circuit means interacts with and automatically controls operation of said first circuit means such that, when said first switch is placed in its first state and said second switch is then actuated to its second state, said second circuit means controls said first circuit means to automatically and sequentially (1), operate said first motor means to position the lens opposite from said rough grinding wheel, (2) operate said second motor means to rough grind the lens, (3) operate said first motor means to position the lens opposite from said bevel edging wheel, and (4) operate said second motor means to bevel edge the lens. Also included is means for enabling said first circuit means, in the absence of said second circuit means, to control operation of said first and second motor means in response to manual actuation of said first and second switches, whereby upon failure of said second circuit means said apparatus is not disabled and may be manually operated.

The foregoing and other objects, advantages and features of the invention will become apparent upon a consideration of the following detailed description, when taken in conjunction with the accompanying drawings.

DETAIL DESCRIPTION

Figure 1:
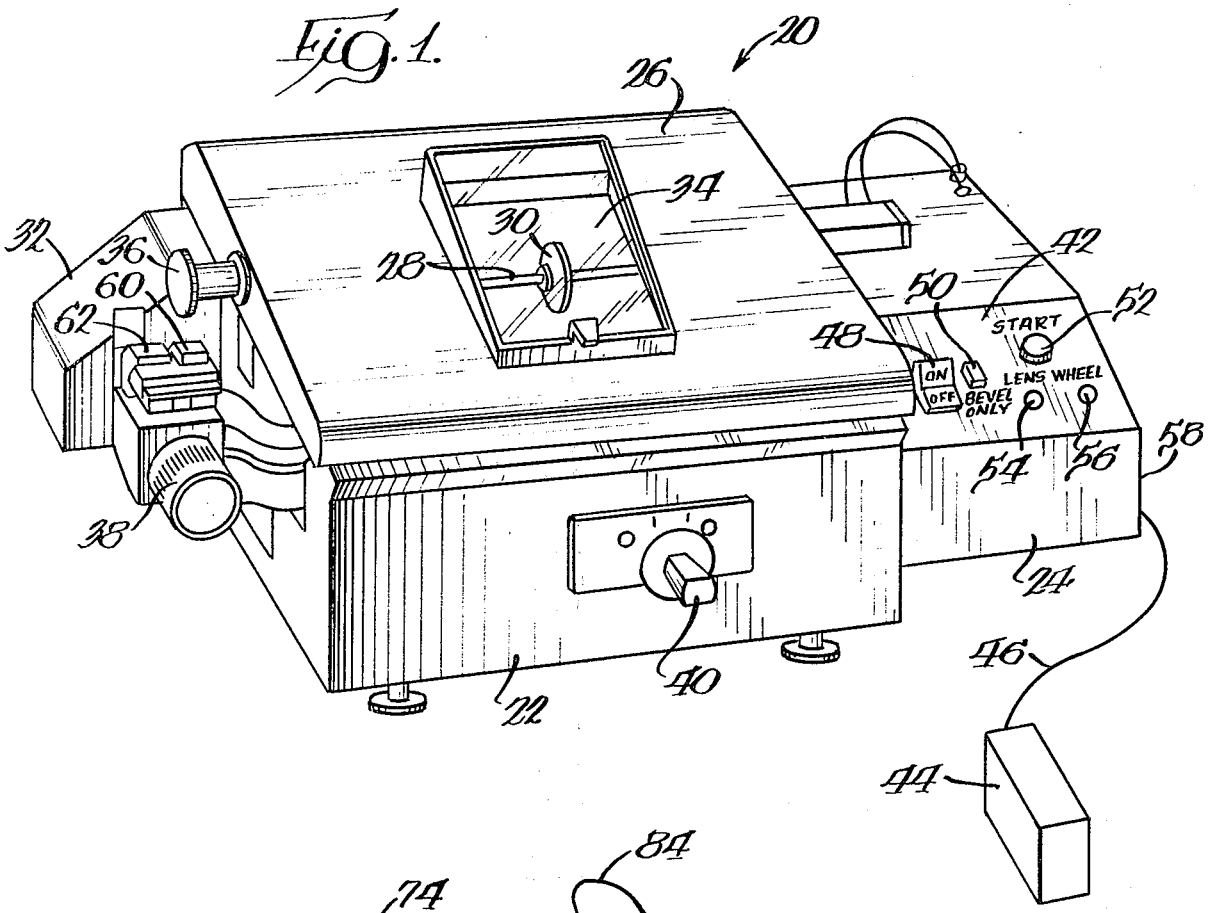
FIG. 1 is a perspective view of an apparatus for grinding the peripheries of eyeglass lenses, of a type with which the teachings of the present invention may advantageously be incorporated.

Referring to FIG. 1, there is indicated generally at 20 a lens edging apparatus for grinding the edges or peripheries of ophthalmic lenses to a predetermined configuration, of a type with which the teachings of the present invention may advantageously be used. The apparatus includes a main base 22 in which a pair of grinding wheels (not shown) are mounted in spaced relationship on a common axis for rotation by a wheel drive motor contained within a housing 24. A floating head assembly or cover 26 is pivotally connected toward its rear to the main base for movement in directions perpendicular to the axis of the grind ing wheels and a float carriage assembly, which includes a rotary workholder 28 for supporting a lens 30 generally along its axis, is mounted in the floating head assembly. The rotary workholder is rotated by a lens drive motor contained within a housing 32, a lens cover assembly comprising a window 34 is in the cover so that the lens may be viewed during the grinding operation, and a former holder assembly 36, for carrying a cam or pattern having a peripheral shape corresponding to the peripheral shape it is desired to impart to the lens, is mounted on the cover for rotation in unison with the workholder. The apparatus also includes an eye-size compound assembly 38 for controlling the overall dimensions to which the periphery of the lens is edged, a bevel control 40 for adjusting the position of a bevel ground on the lens edge and a manually operable instrument control panel 42 for controlling the manufacturing operations performed by the lens edger. In addition, a remote or satellite module 44 is connected with the apparatus through a cable 46, and contains circuitry for automatically controlling operation of the edger in conjunction with the various controls on the control panel.

Figure 2:
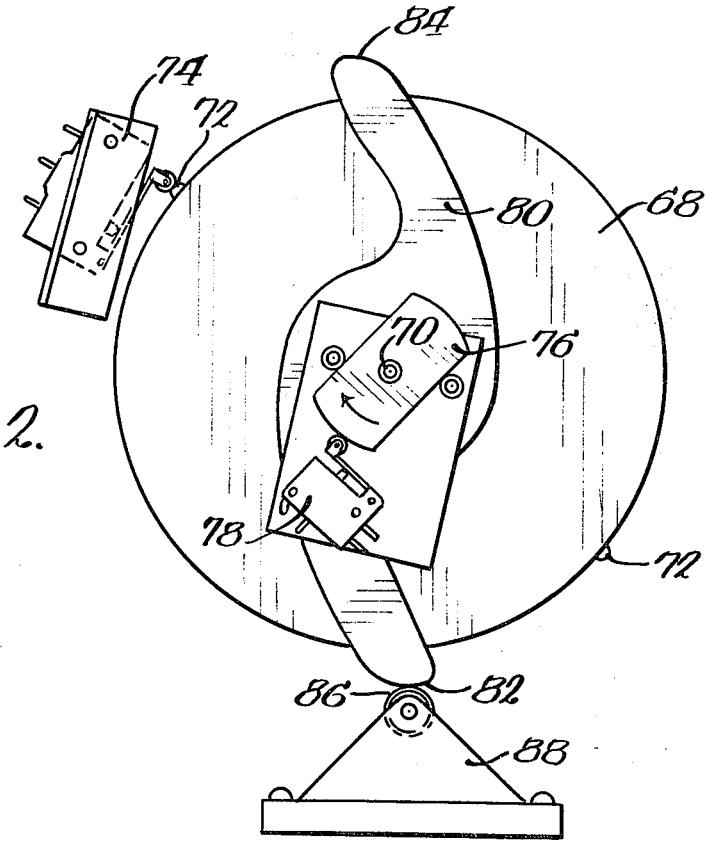
FIG. 2 is a side elevation view of a cycle cam portion of the apparatus of FIG. 1.
Figure 3:
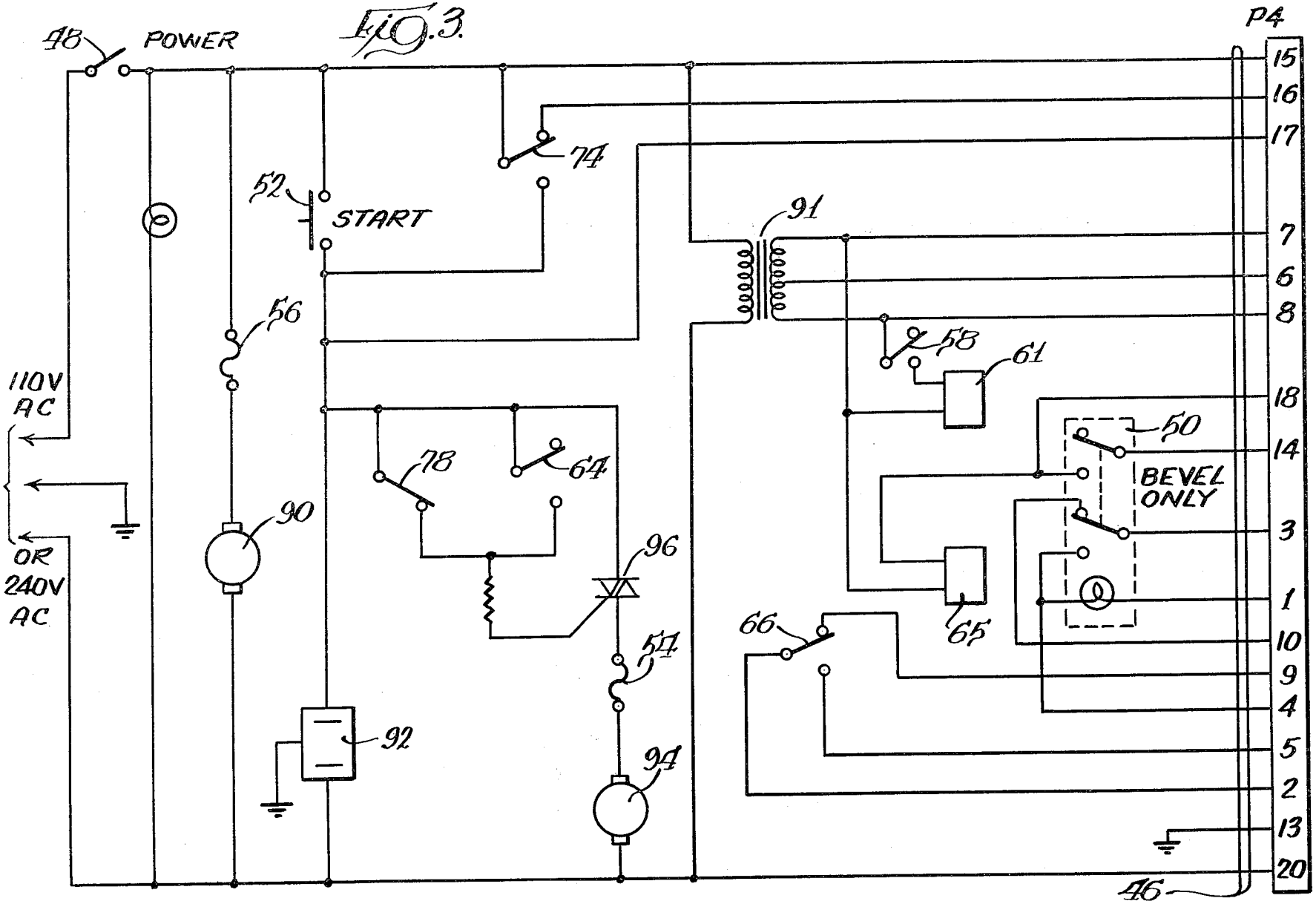
FIG. 3 is a schematic representation of control circuitry which is internal to the apparatus of FIG. 1.

With reference also to FIGS. 2 and 3, the control panel 42 includes a power switch 48, a bevel only switch 50, a start switch 52 and lens and wheel motor drive fuses 54 and 56. In addition, on the right side of the housing 24 there is provided a workholder or chucking switch 58, which is actuable to operate a chucking solenoid 61 to move opposite sides of the workholder 28 toward and away from each other to grip and release the lens 30. Mounted on the eye-size compound assembly 38 are roughing and finishing wear plates 60 and 62, which are movable downwardly upon engagement by a pattern on the former holder assembly 36 for closing, when in the downward position, a former size switch 64. As will be described, the grinding wheels are movable by pneumatic or electric motor means, in response to energization or deenergization of an index solenoid 65, between positions for rough grinding and finishing a lens, and when in the roughing position a roughing sense switch 66 is in the state shown in FIG. 3.

A cycle cam 68, mounted for rotation on an axis 70, is connected with the floating head assembly 26 within the interior of the main base 22. The cycle cam is driven by the lens or workholder drive motor, such that the cam makes one complete revolution for about every four revolutions of the workholder. A pair of nubs or screws 72 on the periphery of the cam engage and deactuate a cycle switch 74 upon movement therepast, whereby the switch is opened twice upon each revolution of the cam. Also mounted on the axis 70 is a former disable cam 76, configured to engage and close a former disable switch 78 twice upon each revolution of the cycle cam. An arm 80, having a pair of cam follower ends 82 and 84 extending beyond the periphery of the cycle cam, is mounted on the cycle cam, and upon each complete revolution of the cycle cam the cam follower ends each engage and move across a cam roller 86 carried by a support bracket 88 mounted on the main base. The arrangement is such that when the cam follower ends engage the roller, the cycle cam and the floating head assembly are moved to an elevated position with respect to the main base, thereby to move a lens carried by the workholder away from the grinding wheels, and when the cam follower ends are not engaging the roller, the cycle cam and the floating head assembly are gravity lowered to bring the lens into engagement with the grinding wheels.

Prior to discussing the particular circuitry shown in FIGS. 3–7, the general operation of the machine during a typical roughing/finishing edging sequence will first be considered. With the cycle cam 68 in its rest and elevated position as shown in FIG. 2, the lens 30 carried by the workholder 28 is held away from the grinding wheels and the rough grinding wheel is at this time positioned opposite from the lens. The start switch is then actuated to initiate an edging sequence, which causes energization of both a pump 92 for providing a flow of coolant to the grinding wheels and the lens drive motor 94 to rotate the workholder and cycle cam through the former disable switch 78. As the cycle cam rotates the cam follower end 82 of the arm 80 moves off of the roller 86 and the floating head assembly 26 is gravity lowered to bring the rotating lens into engagement with the surface of the grinding wheel. Lowering of the floating head also brings a pattern carried on the former holder assembly 36 into engagement with the upper surface of the roughing wear plate 60, which closes the former size switch 64 to establish a power path through the switch to the lens drive motor shortly before the former disable switch 78 opens as a result of rotation of the former disable cam 76. The pattern rotates with the workholder 28, and as it moves across the surface of the plate 60 the floating head is raised and lowered to move the lens toward and away from the grinding surface, thereby to impart an edge configuration to the lens as determined by the peripheral shape of the pattern. To insure that the periphery of the lens is properly ground, the former size switch 64 opens and closes to interrupt operation of the lens drive motor as required, ie, should grinding of the lens move the floating head assembly upward and the pattern away from the wear plate to open the switch, until the required roughing size and shape are obtained on the lens.

The lens makes approximately two revolutions in the roughing position, during which time the cycle cam 68 rotates through about 180° until the cam follower end 84 of the arm 80 engages the roller 86 and elevates the floating head assembly 26 to move the lens away from the grinding wheel. The index solenoid 65 then operates the motor means to shift the grinding wheels along their axis to a position whereat the finishing wheel is opposite from the lens, and to move the finishing wear plate 62 to beneath the pattern on the former holder assembly 36. At this time, the roughing sense switch 66 is actuated to its other state and the floating head assembly 26, which was "locked" against movement in its axial direction during the roughing operation, is "unlocked" and allowed to float in the axial direction of the workholder. With continued rotation of the cycle cam, the cam follower end 84 moves off of the roller and the floating head assembly is gravity lowered to bring the periphery of the lens into engagement with the surface of the finishing wheel and the pattern against the surface of the finishing wear plate 62 to again close the former size switch 64. The lens makes approximately two revolutions in the finishing position, and because the floating head assembly is allowed to float in the axial direction the edge of the lens is automatically centered with respect to the V-shaped groove in the finishing wheel, whereby the bevel formed on the lens is centered around the lens edge. During the finishing operation, the former size switch 64 intermentantly interrupts, as required, operation of the lens drive motor until the required finished size and shape are obtained on the lens. At the end of the finishing operation the cycle cam has rotated through an additional 180°, and the cam follower end 82 again engages the roller 86 to elevate the floating head assembly and move the lens away from the finishing wheel. The grinding wheels are then shifted to position the roughing wheel opposite from the lens, the floating head assembly is "locked" against movement in the axial direction, lens rotation and coolant flow stop and the cycle is completed.

The foregoing described a typical roughing/finishing cycle of operation of the apparatus. However, the bevel only switch 50 allows a choice of either a complete roughing/finishing cycle, a finishing only cycle or a roughing only cycle. In this connection, when the bevel only switch is deactuated, actuation of the start switch 52 causes lenses to be edged through a roughing cycle and then a finishing cycle.

Whenever the bevel only switch 50 is actuated before the start of an edging cycle, however, or before actuation of the start switch, the grinding wheels are immediately shifted to position the finishing wheel directly opposite from or under the lens. All lenses edged while the bevel only switch is actuated will then be manufactured only through a finishing cycle, and at the completion of each finishing cycle no movement of the grinding wheels occurs.

Should it be desired to operate the apparatus through a roughing only cycle, then the bevel only switch 50 is placed in its deactuated position at the time the start switch is actuated. Then, if between 1–30 seconds after the start switch is actuated the bevel only switch is actuated, the apparatus will complete the roughing cycle and the grinding wheels will be shifted to position the finishing wheel beneath the lens, but operation of the machine will stop and no finishing cycle will be initiated. Depressing the bevel only switch to its deactuated position at this time causes the grinding wheels to be shifted so that the roughing wheel is again beneath the lens so that, if desired, the roughing only sequence may be repeated.

As is apparent to one skilled in the art, the eye size compound assembly 38 is adjustable to control the overall dimensions of an edged lens. Operation of the bevel control 40, however, may not be as obvious, and to this end the bevel control allows an operator to control bevel placement on the lens to whatever position is required for the particular minus type of lens to be edged. To this end, and for the purpose of providing a "hidden bevel" on a heavy minus lens, the bevel control is operable to move a nylon finger (not shown) against the plus side of a lens during the finishing operation, thereby to control the position the "floating" lens assumes with respect to the V-shaped groove in the beveling wheel, so that the bevel will be ground parallel with the radius of the plus side of the lens.

Figure 4:
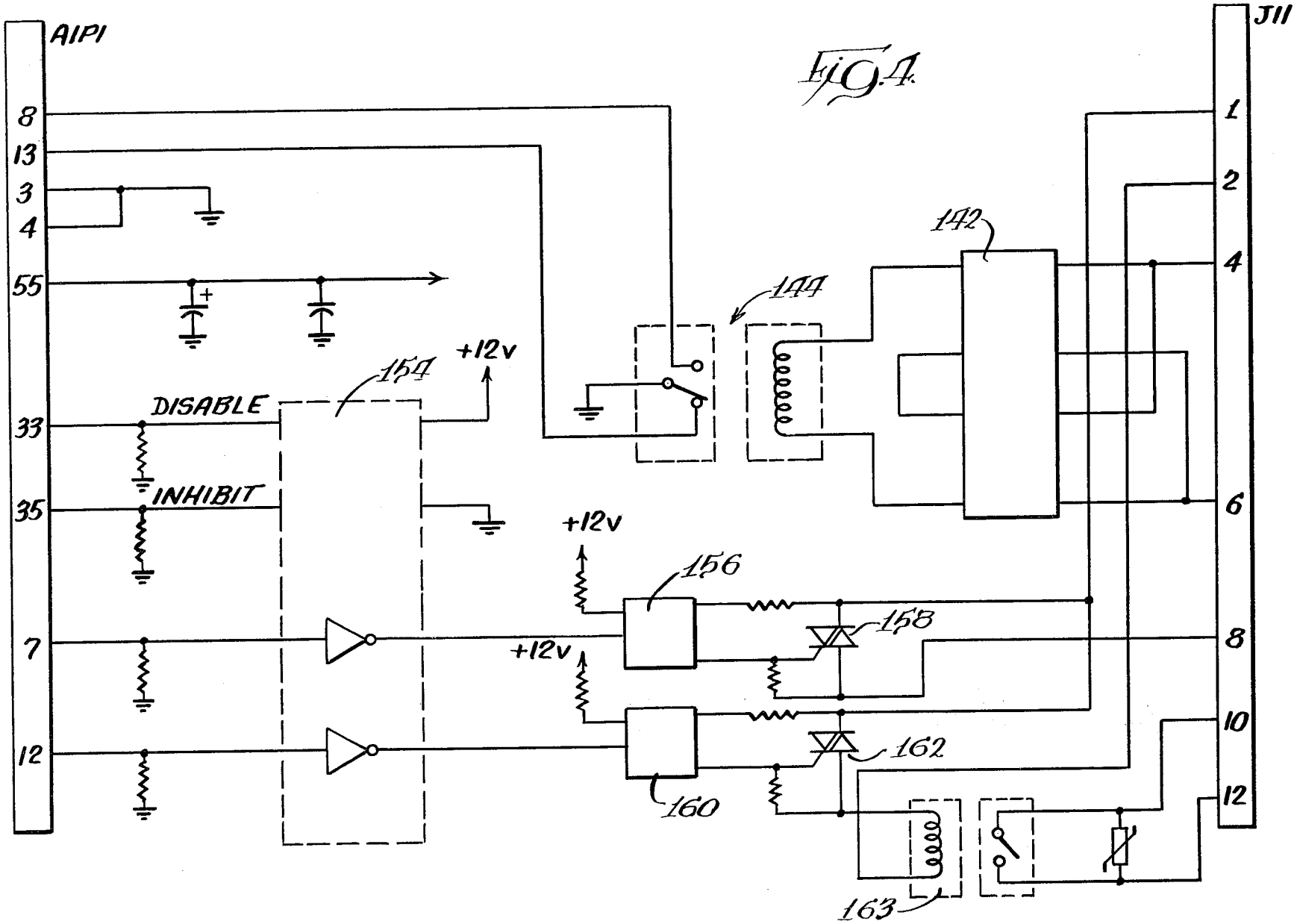
FIG. 4 is a schematic drawing of an input/output circuit of automatic controls for the apparatus which are located in a module remote from the apparatus.
Figure 5:
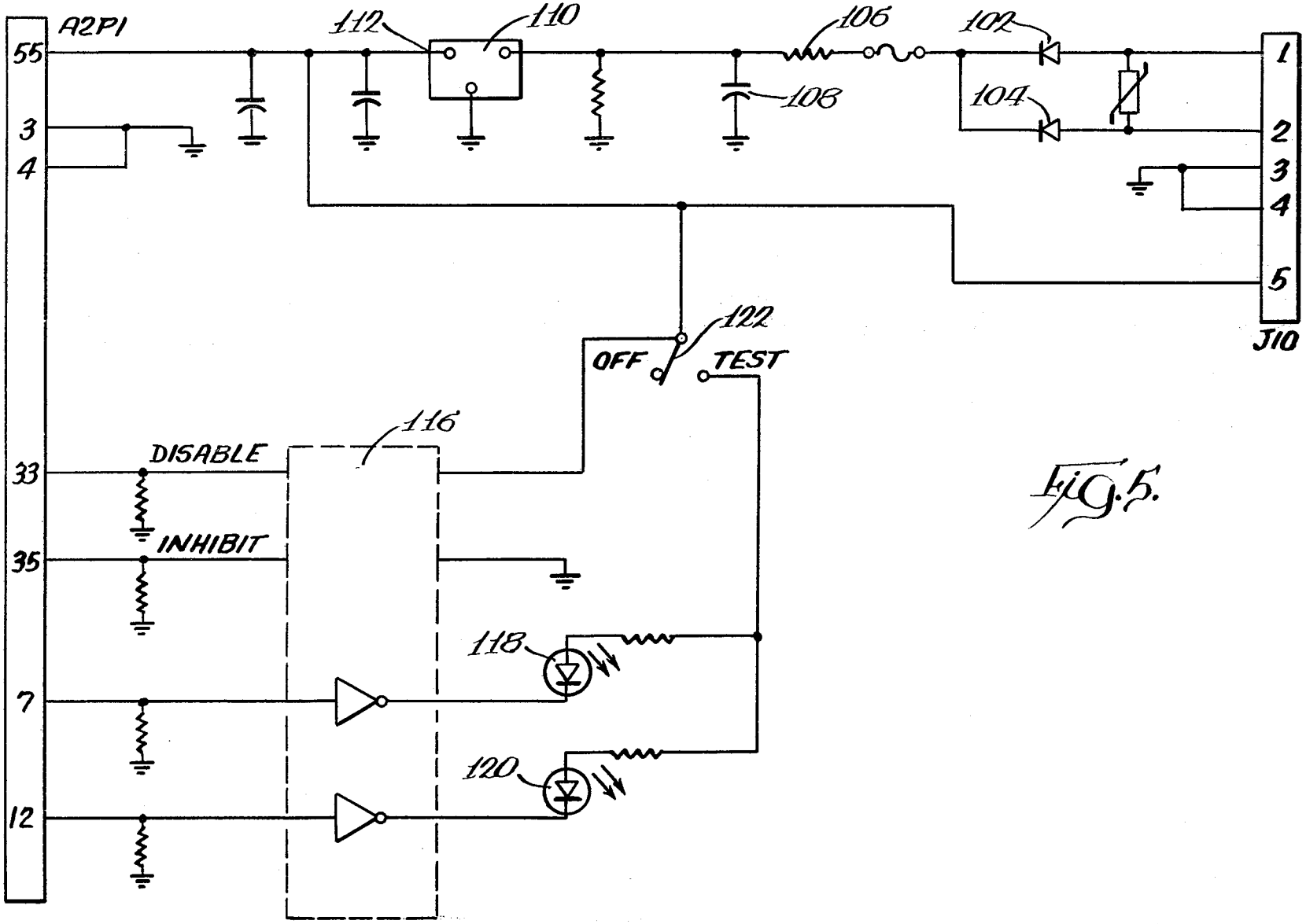
FIG. 5 is a schematic representation of a power supply circuit of the automatic controls.
Figure 6A:
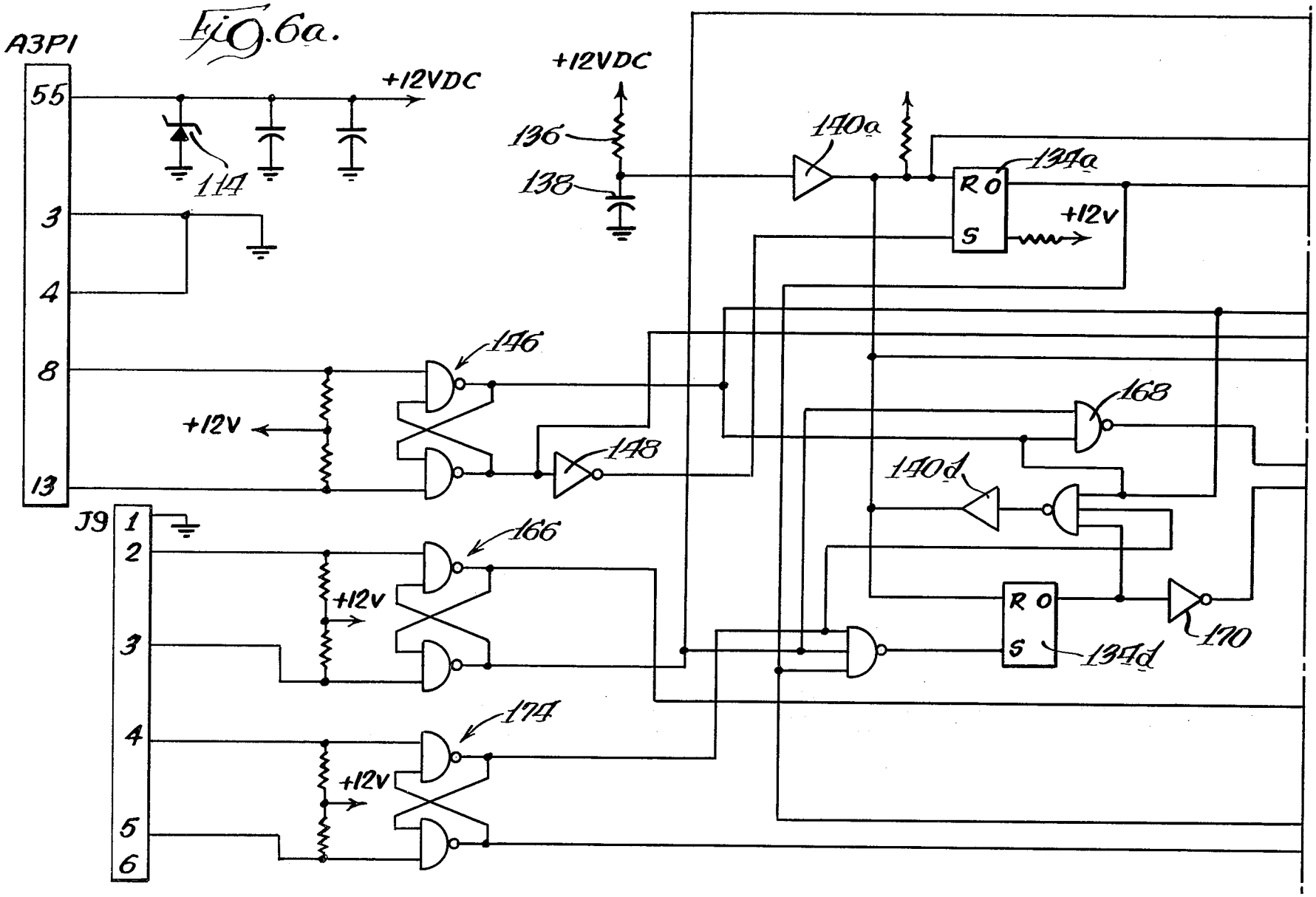
FIGS. 6*a* and 6*b* together comprise a schematic representation of a control circuit portion of the automatic controls.
Figure 6B:
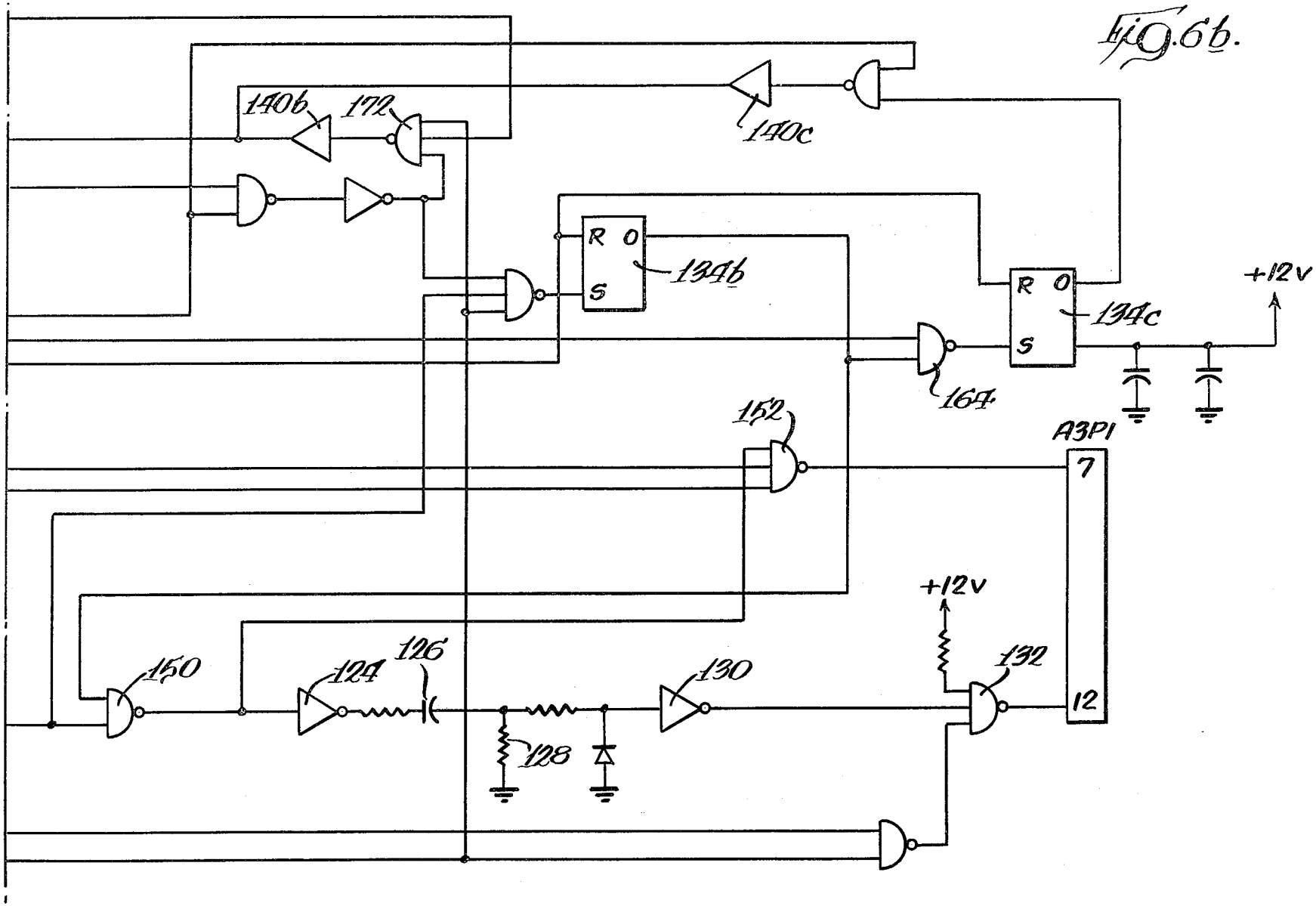
Figure 7:
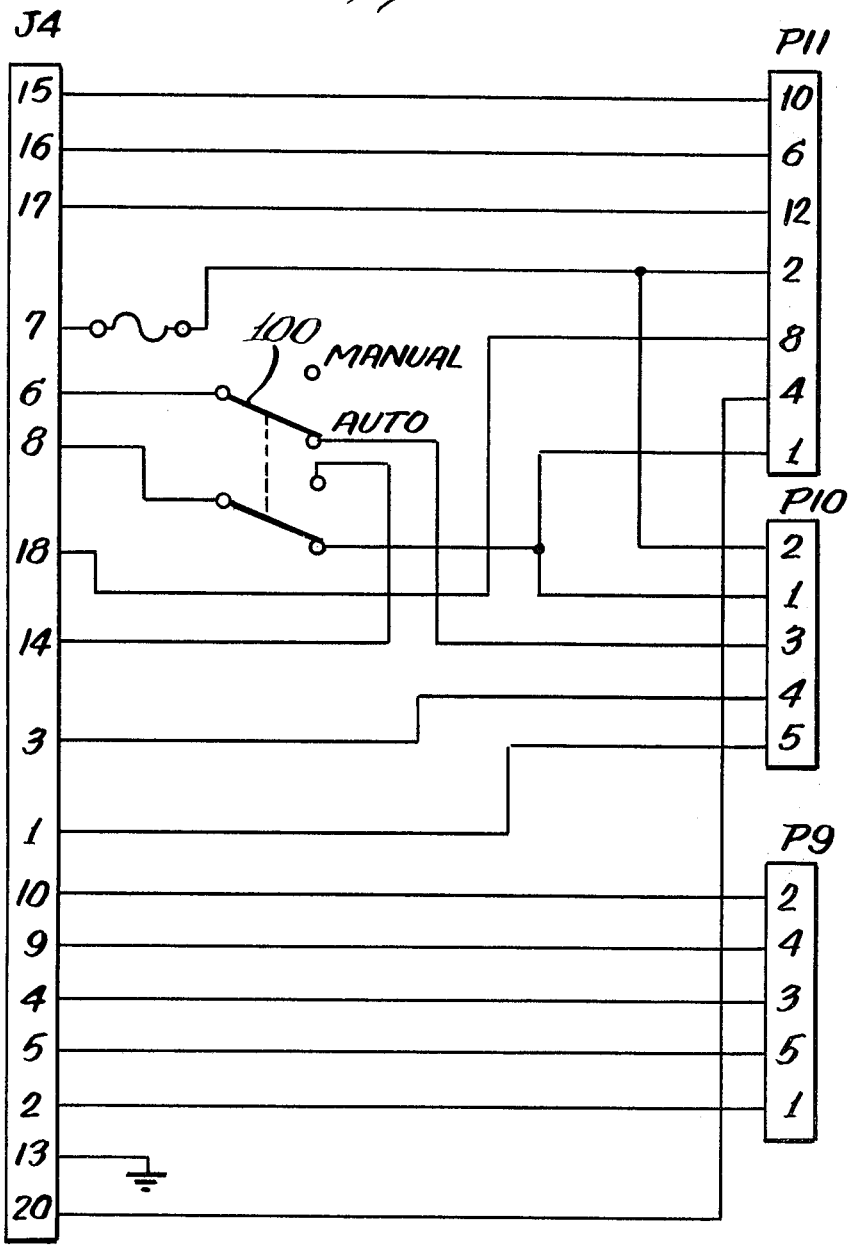
FIG. 7 is a schematic representation of wiring internal to the remote module for interfacing between the circuitry of the module and the circuitry of the edger, which includes a disable switch permitting manual operation of the apparatus should failure of the automatic controls occur.

Turning now to the circuits shown in FIGS. 3–7, FIG. 3 illustrates the circuits internal to the lens edger 20, FIGS. 4–6 the circuits contained in the remote module or satellite 44 and FIG. 7 wiring in the module for interconnecting the circuit in the lens edger with the circuits in the module. The lens edger has a connector P4 at the remote end of the cable 46, which connects with a connector J4 on the module, and connected by wires to the connector J4 are connectors P9, P10 and P11, which in turn connect with associated connectors J9, J10 and J11 of the circuits in the remote module. As is apparent, electrical connections are established between respectively numbered terminals of associated connectors. In addition to having "J" connectors for connecting with associated "P" connectors wired to the connector J4, the circuits within the module also have associated connectors A1P1, A2P1 and A3P1, by means of which connections between the various circuits in the module are established. The arrangement is such that like numbered terminals of the connectors A1P1, A2P1 and A3P1 are electrically interconnected.

Considering first the internal edger circuitry shown in FIG. 3, upon closure of the power switch 48 line voltage is applied directly to a wheel drive motor 90, contained within the housing 24, to rotate the grinding wheels. At this time, the index solenoid 65, which receives a stepped down voltage from a transformer 91, controls the motor means to maintain the grinding wheels in the rough grinding position, the workholder or chucking switch 58 having previously been actuated to energize the chucking solenoid 61 to grip the lens 30 with the workholder 28. With the cycle cam 68 in its home position, the follower of the cycle switch 74 is resting on a nub 72, so that no power is applied through the switch to either the coolant pump 92 or the lens drive motor 94 within the housing 32.

When the start switch 52 is momentarily actuated or closed, power is supplied to the coolant pump 92 and the lens drive motor 94 through a triac 96, the gate of which is at this time under control of the former disable switch 78 which, at the beginning of the edging cycle, is held in a closed position by the former disable cam 76. Energizing the lens drive motor 94 rotates the cycle cam 68, whereupon the cycle switch 74 closes and establishes a bypass path around the start switch to apply power through the triac to the lens drive motor, and the start switch may then be released. As the cycle cam rotates, the cam follower end 82 moves off of the roller 86, the lens is lowered onto the grinding surface of the roughing wheel and the pattern carried by the former holder assembly 36 is lowered onto the surface of the roughing wear plate 60 to close the former size switch 64 prior to the former disable switch 78 opening with continued rotation of the former disable cam. The former size switch then assumes control over the gate of the triac and the supply of power to the lens drive motor, such that the lens drive motor operates whenever the former size switch is closed. As the lens is sized or rough ground, the cycle cam rotates through about 180° until the next nub 72 contacts the follower of the cycle switch, whereupon the cycle switch is actuated to remove the bypass around the start switch. At about the same time, the cam follower end 84 engages the roller 86 and elevates the floating head assembly 26, thereby moving the lens out of engagement with the roughing wheel and opening the former size switch, and the former disable cam 76 contacts the former disable switch 78 to close the switch.

If only a lens roughing cycle had been selected, actuation of the cycle switch 74 removes power from the lens drive motor 94 to terminate the lens manufacturing operation. However, if a roughing/finishing cycle was selected, then at this point the index solenoid 65 is energized to shift the grinding wheels to the finishing position, the roughing sense switch 66 is actuated to the position connecting the terminals 2 and 5 of the connector P4 and the terminal 15 of the connector is coupled with the terminal 17 to bypass the start and cycle switches and apply power through the triac 96 to the lens drive motor 94, with the gate of the triac again being enabled through the former disable switch 78. Continued rotation of the cycle cam 68 then moves the cam follower end 84 off of the roller 86 to lower the periphery of the lens into the V-shaped groove of the finishing wheel, moves the nub 72 away from the follower of the cycle switch and rotates the former disable cam 76 to open the former disable switch 78 after closure of the former size switch 64. Upon the cycle cam rotating through an additional 180°, the cam follower end 82 again engages and rides up on the roller 86, and the lens roughing/finishing cycle is completed.

If it is desired to manufacture the lens through a finishing cycle only, then the bevel only switch 50 is actuated prior to closure of the start switch 52. Under this circumstance, the index solenoid 65 is energized, before start of the edging cycle, to shift the grinding wheels and position the finishing wheel opposite from the lens, whereupon closure of the start switch initiates a finishing cycle, at the end of which power is not connected from the terminal 15 of the connector P4 to the terminal 17, thereby terminating the cycle of operation.

On the other hand, if it is desired to manufacture the lens through a roughing only cycle, then the bevel only switch 50 is actuated after closure of the start switch 52. Under this circumstance, the lens is brought into engagement with the roughing wheel, but at the end of the roughing operation there is no connection of power from the terminal 15 of the connector P4 to the terminal 17, and the lens is not cycled through a finishing operation.

The automatic control circuitry in the satellite module 44 consists of an input/output circuit, a control circuit and a power supply circuit, and is connected with the internal edger circuitry through the cable 46. The connector J4 on the module mates with the connector P4 on the cable, the connector P9 mates with a connector J9 of the control circuit (FIG. 6*a–b*), the connector P10 couples with a connector J10 of the power supply circuit (FIG. 5) and the connector P11 joins with a connector J11 of the input/output circuit (FIG. 4). Included in the module wiring (FIG. 7) and mounted on the module is an auto/manual switch 100, which is manually actuable between two states to place the lens edger 20 in a condition for having its lens manufacturing operations either automatically or manually controlled, as will be described. For the state of the switch shown, the circuitry is enabled for automatic control of the edger.

Considering first the power supply circuit in FIG. 5, about 24 volts a.c. is applied across terminals 1 and 2 of the connector J10 from the outer taps of the stepdown transformer 91 (FIG. 3), and terminal 3 of the connector receives ground potential from a center tap of the transformer. The voltage across terminals 1 and 2 is full wave rectified by a pair of diodes 102 and 104, and filtered by a resistor 106 and a capacitor 108. The rectified voltage of approximately 20 volts d.c. is applied as an input to a linear voltage regulator 110, which generates at an output 112 therefrom a constant 12 volts d.c. as an operating voltage for the circuitry. A normally nonconductive Zener diode 114 of the control circuit (FIG. 6*a*), having a breakdown voltage of about 15 volts, is provided to protect the circuitry should failure of the voltage regulator occur.

The power supply also includes an inverter-buffer circuit 116, which may be a Motorola Model MC14502B strobed hex inverter-buffer. The circuit includes a pair of inverters the inputs to which connect with pins 7 and 12 of the connector A2P1 and the outputs from which are applied through a pair of light emitting diodes 118 and 120 to a test terminal of a switch 122. The inverter-buffer circuit also has a disable input and an inhibit input, and the arrangement is such that a high state or signal (12 volts) at the disable input causes the outputs from the circuit to float while a high signal at the inhibit input forces all of the outputs to a low state (ground). The circuit 116 does not perform any particular function in the overall operation of the automatic control circuitry, but is provided so that the light emitting diodes 118 and 120 may be used to monitor the occurrance of signals generated by the control circuit and applied to the input/output circuit when the switch 122 is in the test position.

The input/output circuit (FIG. 4) powers up the loads in response to various control signals generated, and the control circuit (FIG. 6*a–b*) controls all of the fully automatic functions of the lens edger, including indexing the grinding wheels between the shaping and finishing positions. The control circuit includes a timer comprising an inverter 124, a capacitor 126 and a resistor 128, and when the input to the inverter goes low, its output goes high and the voltage at the juncture of the capacitor and resistor increases until, after about 2.5 seconds, it becomes sufficiently positive to drive the output from an inverter 130 to a low state. The low output from the inverter 130 is applied as an input to a NOR gate 132, which in turn applies a high value signal to a pin 12 of the connector A3P1 and therefore to pin 12 of the connector A1P1 of the input/output circuit, for a purpose which will later be described. The control circuit also has four reset-set latches 134*a*, 134*b*, 134*c* and 134*d*, and a timing circuit comprising a resistor 136 and a capacitor 138 insures that all of the latches are initially reset when power is first turned on. Each of the latches 134*a–d* has a reset input R, a set input S and an output O, and the arrangement is such that when a latch is set its output is low and when reset its output is high. Four gates 140*a*, 140*b*, 140*c*, and 140*d* are associated with the latches, and operate as open-drain buffers so that their outputs can be tied together.

Assuming all of the latches 134*a–d* are reset, starting an edging cycle changes the state of the cycle switch 74 and removes power from a stepdown transformer 142 of the input/output circuit, thereby deenergizing a relay 144. This causes a ground signal to be applied from the relay contact to one input to a latching circuit 146 of the control circuit, thereby applying a low signal from the output of an inverter 148 to the set input to the latch 134*a* to set the latch. Then, on the next actuation of the cycle switch 74, the latch 134*b* is set and the output from the latch is applied through a pair of NOR gates 150 and 152 to generate a high signal at pin 7 of the connector A3P1. The high signal at pin 7 of the connector is applied to an inverter-buffer circuit 154 of the input/output circuit, which may comprise a Motorola Model MC14502B strobed hex inverter-buffer, thereby to enable a triac gate drive circuit 156 to render a triac 158 conductive to energize the index solenoid 65 and shift the grinding wheels to the finishing position. At the same time, the output from the NOR gate 150 applies an input to the inverter 124 of the timer circuit, thereby to generate a high signal at pin 12 of the connectors A1P1 and A3P1. The high signal is applied to the inverter-buffer circuit 154 to enable a triac gate drive circuit 160 to render a triac 162 conductive to energize a relay 163, the contact of which then establishes a bypass path around the cycle switch 74.

Upon the next actuation of the cycle switch 74, which occurs at the end of the finishing cycle, power is again applied to the stepdown transformer 142 to energize the relay 144 and present a ground signal at pin 8 of connector A1P1 and therefore at the other input to the latching circuit 146, thereby to switch the latching circuit to its original state and generate at an output therefrom and through a NOR gate 164 a signal to set the latch 134*c*. Setting the latch 134*c* resets all of the latches 134*a–d*, thereby causing the high signal to be removed from pin 7 of connector A3P1. Removal of the high signal from pin 7 disables the triac gate drive circuit 156, thereby removing power from the index solenoid 65 to shift the grinding wheels back to the roughing position.

If the bevel only switch is actuated, or placed in a state opposite from that shown in FIG. 3, as long as the cycle switch 74 engages a nub 72 power continues to be applied to the index solenoid 65 to energize the solenoid and maintain the grinding wheels in the finishing position. There are two ways to maintain an energizing signal at the index solenoid by means of the control circuit. One is through a latching circuit 166, the inputs to which are connected with pins 2 and 3 of the connector J9, and therefore with the bevel only switch. When the bevel only switch is actuated, an output from the latching circuit is applied through a NOR gate 168 and the NOR gate 152 to apply a high signal to pin 7 of connector A3P1, which enables the triac gate drive circuit 156 to maintain the index solenoid energized. If the bevel only switch is deactuated, the high signal is removed from pin 7 and the index solenoid is deenergized to return the grinding wheels to the roughing position.

The second means for maintaining the index solenoid 65 energized when the bevel only switch 50 is actuated includes the latch 134*d*. When the bevel only switch is actuated, upon initiation of an edging cycle the cycle switch 74 is actuated and sets the latch 134*d*, the output from which is applied through an inverter 70 and the NOR gate 152 to apply a high signal to pin 7 of the connector A3P1, thereby to maintain the index solenoid energized. The high signal at pin 7 is then removed to deenergize the index solenoid only if the bevel only switch is deactuated at the end of the edging cycle, at which time the cycle switch again engages a nub 72.

To accomplish a roughing only cycle, once the start switch 52 is actuated and the cycle switch 74 moves off of a nub 72, the latch 134*a* is set. If at this time the bevel only switch 50 is actuated, all of the latches 134*a–d* are reset the next time the cycle switch engages a nub, or at the end of the roughing cycle. This is accomplished through a NOR gate 172, a first input to which receives the output from the latching circuit 166, which is under control of the bevel only switch, a second input to which receives the output from a latching circuit 174, which is under control of the roughing sense switch 66 and a third input to which receives the output from the latching circuit 146, which is responsive to actuation of the cycle switch 74. Resetting all of the latches 134*a–d* at the end of the roughing cycle applies an input to the NOR gate 150 which inhibits the timer circuit which includes the inverter 124, thereby removing the high signal from pin 12 of the connector A3P1 and disabling the triac gate drive circuit 160 of the input/output circuit. Disabling the triac gate drive circuit deenergizes the relay 163 to remove the bypass path around the cycle switch and interrupt operation of the pump motor 92 and the lens drive motor 94. However, at this time a high signal is generated at pin 7 of the connector A3P1 to shift the grinding wheels to the finishing position, even though the pump and lens drive motor are off. Consequently, a roughing only cycle is accomplished.

The circuits internal to the lens edging apparatus are connected with the automatic control circuits through the cable 46, and interact with the automatic control circuits in efficiently and conveniently cycling the lens edger through its various manufacturing operations. It is possible, however, that the automatic control circuitry may fail and require replacement or repair. Should that occur, then to the extent of the description thus far, the lens edger would be disabled and placed out of use.

Should the automatic control circuitry fail, to avoid the need to place the lens edger completely out of use until the circuitry can be repaired, the invention contemplates the provision of automatic control circuitry bypass means, which allows the lens edger to be manually cycled through its various manufacturing stages without need for or reliance on the automatic circuits. In particular, and with reference to FIG. 7, the manual-/automatic switch 100, when placed in the manual state, allows the various manufacturing stages of the lens edger to be manually initiated without reliance on the automatic control circuitry. It is understood, of course, that the switch 100 need not necessarily be incorporated in the module 44, but could just as readily be located at the lens edger itself.

Considering the operation of the manual/automatic switch 100, when the same is placed in the manual mode terminals 8 and 14 of the connectors J4 and P4 are interconnected. This provides 24 volts a.c. at pin 14 of the connector P4, whereby the bevel only switch 50 may be actuated to energize or deenergize the index solenoid 65 to shift the grinding wheels between the roughing and finishing positions. Thus, if it is desired to both rough grind and bevel edge a lens, with the bevel only switch in its deactuated state, the start switch 52 is pressed to initiate a roughing cycle. After the cycle cam 68 rotates through about 180° and at the end of the roughing stage, operation of the lens drive motor 94 is interrupted, since absent the automatic control circuitry there is not at this time a bypass around the cycle switch. Nevertheless, the lens may be manufactured through a finishing cycle by actuating the bevel only switch to energize the index solenoid 65 and shift the grinding wheels to the finishing position, whereupon the start switch may be pressed to bevel edge the lens.

Obviously, if it were desired to only rough grind a lens, then at the end of the roughing cycle the bevel only switch would not be actuated and the lens could simply be removed from the workholder. On the other hand, if it were desired to only bevel edge a lens, then after a lens blank is mounted in the workholder, and before the start switch 52 is pressed, the bevel only switch may be actuated to energize the index solenoid and shift the grinding wheels to the finishing position, whereupon the start switch may be pressed to cycle the lens through a finishing operation.

It should be appreciated, of course, that it is not necessary for the automatic control circuits to fail for manual control to be exercised over the lens edger. Simply, and irrespective of whether the automatic circuits are operative or inoperative, whenever it is desired to manually cycle the lens edger, as above described, through its various manufacturing stages, it is only necessary that the switch 100 be placed in its manual state.

While embodiments of the invention have been described in detail, various modifications and other embodiments thereof may be devised by one skilled in the art without departing from the spirit and scope of the invention, as defined in the appended claims.

What is claimed is:

1. An apparatus for grinding the peripheral edges of ophthalmic lenses to a predetermined configuration, comprising a pair of grinding wheels, one a rough grinding wheel and the other a bevel edging wheel, rotating about a first axis; a rotary workholder for supporting and rotating a lens about a second axis generally parallel to the first; first motor means operable to shift said grinding wheels and workholder relative to each other to selectively position the periphery of the lens opposite from a grinding surface of one of said grinding wheels; second motor means cyclically operable to rotate said workholder and to then sequentially (a) move said grinding wheels and workholder toward each other to engage the periphery of the rotating lens with the grinding surface of the wheel opposite from the lens, (b) move said grinding wheels and workholder toward and away from each other in a predetermined manner while the rotating lens is engaged with the grinding surface to grind the periphery of the lens to a predetermined configuration, and (c) move said grinding wheels and workholder away from each other to disengage the lens from the grinding surface; first circuit means, including first and second switches each manually actuable between first and second states, for controlling operation of said first and second motor means, such that actuation of said first switch to its first state operates said first motor means to position the lens opposite from said rough grinding wheel and actuation to its second state operates said first motor means to position the lens opposite from said bevel edging wheel, and actuation of said second switch to its second state initiates a cycle of operation of said second motor means; second circuit means electrically connected with but separate and disconnectable from said first circuit means, said second circuit means interacting with and automatically controlling operation of said first circuit means such that, when said first switch is placed in its first state and said second switch is then actuated to its second state, said second circuit means controls said first circuit means to automatically and sequentially (1) operate said first motor means to position the lens opposite from said rough grinding wheel, (2) operate said second motor means to rough grind the lens, (3) operate said first motor means to position the lens opposite from said bevel edging wheel, and (4) operate said second motor means to bevel edge the lens; and including means for enabling said first circuit means, in the absence of said second circuit means, to control operation of said first and second motor means in response to manual actuation of said first and second switches, whereby upon failure of said second circuit means said apparatus is not disabled and may be manually operated.

2. An apparatus as in claim 1, wherein said means for enabling said first circuit means includes third switch means manually actuable between first and second states, said third switch means when placed in its first state placing said first circuit means under control of said second circuit means, such that said first circuit means interacts with said second circuit means to control operation of said first and second motor means, and when placed in its second state enables said first circuit means to control operation of said first and second motor means, independently of said second circuit means, in response to actuation of said first and second switches.

3. An apparatus as in claim 2, wherein upon placement of said third switch in its second state a lens may be rough ground and bevel edged by sequentially (a) actuating said first switch to its first state to operate said first motor means to position the lens opposite from said rough grinding wheel, (b) actuating said second switch to its second state to operate said second motor means to rough grind the lens and, after the cycle of operation of said second motor means is completed, (c) actuating said first switch to its second state to operate said first motor means to position the lens opposite from said bevel edging wheel, and (d) again actuating said second switch to its second state to operate said second motor means to bevel edge the lens.

4. An apparatus as in claim 1, wherein said apparatus includes a main body portion for housing and/or supporting said grinding wheels, said workholder, said first and second motor means, said first circuit means and said first and second switches, and including a module remote from said main body portion for housing said second circuit means, and a cable for electrically interconnecting said first circuit means in said main body portion with said second circuit means in said module.

5. An apparatus as in claim 4, wherein said means for enabling said first circuit means comprises a third switch electrically connected with said first circuit means and actuable between a first state in which said first circuit means interacts and cooperates with said second circuit means in controlling operation of said first and second motor means and a second state in which said first circuit means operates independently of said second circuit means in controlling operation of said first and second motor means.

6. An apparatus as in claim 5, wherein said third switch is mounted on said module and is electrically connected with said first circuit means through said cable.

7. An apparatus as in claim 5, wherein said third switch is part of said cable and is electrically connected with said first circuit means through said cable.

8. An apparatus as in claim 5, wherein said third switch is mounted on said main body of said apparatus.

* * * * *